US011780702B2

(12) United States Patent
Kampmann et al.

(10) Patent No.: US 11,780,702 B2
(45) Date of Patent: Oct. 10, 2023

(54) DEVICE AND METHOD FOR BRAKING A CONDUCTOR

(71) Applicant: SCHLEUNIGER AG, Thun (CH)

(72) Inventors: Roland Kampmann, Witten (DE); Uwe Keil, Hückeswagen (DE); Andreas Zahle, Radevormwald (DE)

(73) Assignee: Schleuniger AG, Thun (CH)

( * ) Notice: Subject to any disclaimer, the term of this patent is extended or adjusted under 35 U.S.C. 154(b) by 327 days.

(21) Appl. No.: 17/268,741

(22) PCT Filed: Aug. 14, 2019

(86) PCT No.: PCT/IB2019/056895

§ 371 (c)(1),
(2) Date: Feb. 16, 2021

(87) PCT Pub. No.: WO2020/035801

PCT Pub. Date: Feb. 20, 2020

(65) Prior Publication Data

US 2022/0119219 A1 Apr. 21, 2022

(30) Foreign Application Priority Data

Aug. 17, 2018 (CH) ..... 1004/18

(51) Int. Cl.
*B65H 59/16* (2006.01)
*B65H 59/22* (2006.01)

(52) U.S. Cl.
CPC ..... *B65H 59/16* (2013.01); *B65H 59/22* (2013.01); *B65H 2701/34* (2013.01)

(58) Field of Classification Search
CPC ..... B65H 59/16; B65H 59/22; B65H 2701/34
See application file for complete search history.

(56) References Cited

U.S. PATENT DOCUMENTS 3,118,635 A 1/1964 Landsem
4,445,668 A 5/1984 Sauber
(Continued)

FOREIGN PATENT DOCUMENTS

DE 588 567 11/1933
DE 588567 C 11/1933
(Continued)

OTHER PUBLICATIONS

Machine Translation of JP 2004-52292 A. Mar. 18, 2004. (Year: 2004).*

(Continued)

*Primary Examiner* — William E Dondero
(74) *Attorney, Agent, or Firm* — Finch & Maloney PLLC

(57) ABSTRACT

A device (100) for braking a conductor. The device (100) comprises a braking element (10), which is able to be put into an operative connection with a conductor guided in a conveying direction of the device (100), and a contact pressure element (20) which is able to put into an operative connection with the conductor guided in the device (100). The contact pressure element (20) is arranged opposite the braking element (10) and the elements are movable relative to one another. The contact pressure element (20) is arranged on a brake lever (30) mounted in a pivotable manner on a pivot pin (31). Furthermore, a method for braking the conductor and to a cable processing machine having the device (100) are also disclosed.

21 Claims, 5 Drawing Sheets

(56) References Cited

U.S. PATENT DOCUMENTS

Figure 1:
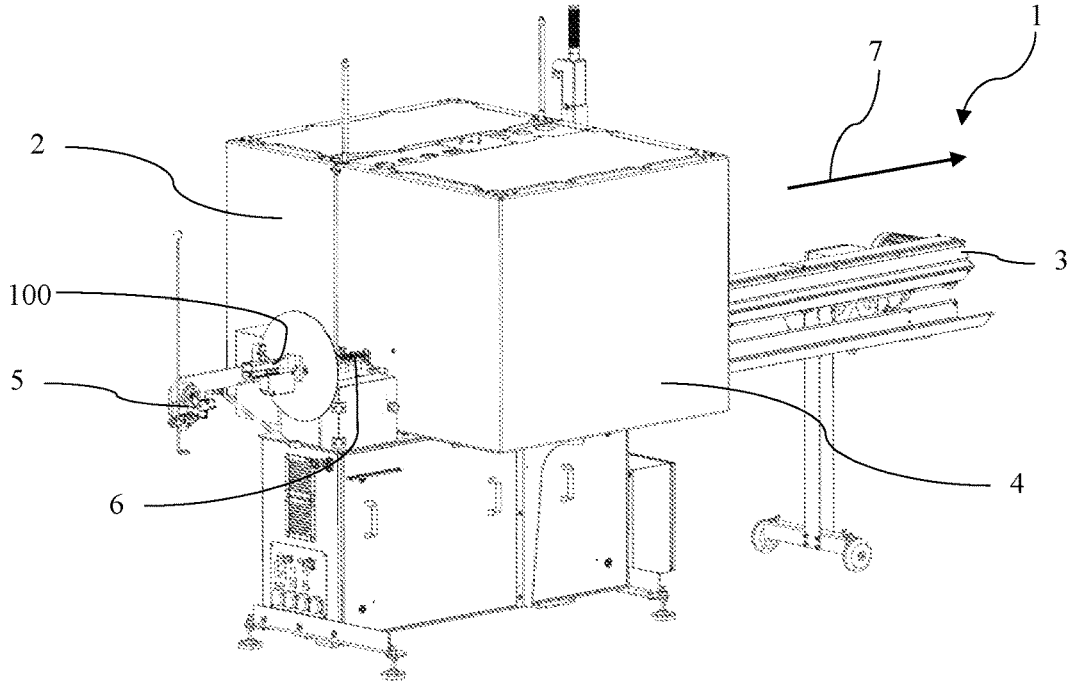

| | | | | |
|---|---|---|---|---|
| 4,516,739 | A | 5/1985 | Wyatt | |
| 5,342,000 | A * | 8/1994 | Berges | B65H 59/00 242/155 M |
| 5,421,534 | A | 6/1995 | Arnold et al. | |
| 2007/0278054 | A1* | 12/2007 | Huss | B65H 59/22 188/161 |
| 2015/0008245 | A1 | 1/2015 | Wortmann | |

FOREIGN PATENT DOCUMENTS

| | | | |
|---|---|---|---|
| DE | 1021318 | B | 12/1957 |
| DE | 2749797 | A1 | 5/1979 |
| DE | 9306180 | U1 | 9/1993 |
| DE | 198 60 608 | A1 | 7/2000 |
| DE | 102013002020 | A1 | 8/2014 |
| EP | 0394709 | A2 | 10/1990 |
| EP | 0564018 | A2 | 10/1993 |
| EP | 2 776 353 | B1 | 5/2016 |
| EP | 3 290 370 | A1 | 3/2018 |
| EP | 3290370 | A1 | 3/2018 |
| FR | 1 188 084 | | 3/1959 |
| JP | 2004-082292 | A | 3/2004 |
| JP | 2013-021137 | A | 1/2013 |

OTHER PUBLICATIONS

International Search Report Corresponding to PCT/IB2019/056895 dated Dec. 12, 2019.
Written Opinion Corresponding to PCT/IB2019/056895 dated Dec. 12, 2019.
Swiss Search Report issued in corresponding Swiss Patent Application No. CH01004/18 dated Dec. 11, 2018.

* cited by examiner

DEVICE AND METHOD FOR BRAKING A CONDUCTOR

The invention relates to a device for braking a conductor, a method for braking a conductor, and a cable processing machine comprising a device for carrying out a method of such kind according to the preambles of the independent claims.

In the cable or conductor processing industry, the product to be processed (cable, conductor or also wire) is advanced as a part, but processing is typically performed according to a timed cycle. In other words, this means that the product to be processed must be accelerated and slowed down. A device for transporting a conductor has been disclosed for example in EP 2 776 353 B1. The conductor that is to be transported/processed is typically processed in the conveying direction after the conductor transport device. If the conductor has to be cut, for example, it must be slowed and stopped before this processing step. The conductor is typically unwound from a spool with the conductor transport device. This sets the spool in motion, which must then also be slowed at the same time to prevent a loop from forming between the spool and the conductor transport device. For this purpose, devices have been disclosed which act directly on the spool to brake it.

However, devices of such kind are unsuitable for example if the conductors are being drawn from a loose cable storage unit. Particularly for these structures, alternative solutions must be found for braking the conductors to prevent loop formation.

A wire brake is disclosed in DE 198 60 608 A1. With this apparatus, the wire to be advanced is wound round a brake wheel, and said brake wheel is braked by means of a disc brake. The braking force is adjusted by means of a final control element which is controlled via a pivoting arm.

The apparatus of DE 198 60 608 A1 has a complicated construction, it responds slowly to control, and in order for it to be used, the product which is to be advanced, in this case a wire, must be deflected and bent several times.

DE 588 567 C describes a cable stranding machine for improving a capacity symmetry of multicore telecommunications cables by braking the strands before the stranding point. The cable stranding machine comprises two brake discs, which are caused to rotate by a core that is movable between them. At least one of the two brake discs is moved into contact by means of a Helical spring, the pressure of which can be regulated with a setscrew.

The drawback associated with this cable stranding machine is that the conductor to be braked cannot be braked selectively.

EP 3 290 370 A1 describes a wire drawing apparatus for feeding a wire in a feed direction. Said wire drawing apparatus is equipped with a brake roller and a pressure roller which are positioned opposite each another and mounted so as to be movable relative to each other. The pressure roller is mounted on a biasing device.

The drawback associated with this wire drawing apparatus is that the brake roller is driven, and must be configured so that it works against the wire run during feeding of the wire by rotating in a braking direction.

The object of the present invention is to create a device which remedies at least one or more drawbacks of the related art and in particular provides a simple and/or inexpensive and/or material-conserving device for braking a conductor.

A further object of the present invention is to create a suitable method therefor.

These objects are solved with the apparatuses and methods defined in the independent claims. Further embodiments may be discerned from the dependent claims.

A device according to the invention for braking a conductor, in particular for braking a cable, comprises a braking element which is able to be put into operative connection with a conductor guided in a conveying direction. The device also has a contact pressure element which is able to be put into operative connection with a conductor guided in a conveying direction. The contact pressure element is arranged opposite the braking element, and the braking element and the contact pressure element are arranged so as to be movable relative to one another. The contact pressure element is arranged on a positioning apparatus. The positioning apparatus is an apparatus which makes it possible to move the contact pressure element actively. The contact pressure element is preferably arranged on a brake lever mounted in pivotable manner on a pivot axis or on a linear actuating apparatus.

The conveying direction is substantially the direction in which the conductor to be conveyed extends during use according to the invention.

An arrangement of such kind makes it possible to influence the conductor directly with the contact pressure element, thereby bringing the conductor into operative connection with the braking element and in particular clamping the conductor between the braking element and the contact pressure element.

This in turn makes it possible to adjust the strength of the braking force according to the clamping strength.

The arrangement of the contact pressure element on a positioning apparatus, in particular a pivotably mounted brake lever or on a linear actuating apparatus enables that braking force to be adjusted simply and the contact pressure element to be moved easily relative to the braking element.

A linear actuating apparatus is preferably substantially arranged in such manner that its direction of motion extends substantially at right angles to the conveying direction.

A brake lever is preferably arranged in such manner that its pivot axis extends substantially transversely to the conveying direction. A rocking motion is thus generated substantially at right angles to the conveying direction. A brake lever is typically of elongated construction.

The device for braking the conductor may easily be located in front of a cable processing machine or after a cable storage unit, so that the braking of the conductor is carried out before the first active conductor processing step, typically before straightening of the conductor.

The contact pressure element may have a friction surface for cooperating with the conductor.

This enables the generation of a specific friction between the conductor and the contact pressure element. In this way, it is possible to prevent unnecessary wear of the conductor and/or the contact pressure element.

The coefficient of friction of the friction surface is preferably less than 0.2, more preferably less than 0.15, but in particular not less than 0.05. This ensures that the conductor is not exposed to excessive wear, but preferably still generates enough friction to ensure that the contact pressure element cooperates with the conductor as intended while the force acting on the conductor does not become too great.

The braking element preferably has a friction surface for cooperating with the conductor. In particular, the braking element may have a ceramic surface and is preferably made as a single part from ceramic. Alternatively, provision may also be made to furnish the braking element with a coating of other commonly used materials such as plastic, natural or synthetic fabrics or fibre composite materials or sintered materials or to produce them from such materials.

This enables the provision of a specific friction between the conductor and the braking element. In this way it is possible to prevent unnecessary wear of the conductor and/or the braking element.

The coefficient of friction of the friction surface is preferably less than 0.2, more preferably less than 0.15, but in particular not less than 0.05. This ensures that the conductor is not exposed to excessive wear, but is preferably still braked sufficiently while the force acting on the conductor does not become too great.

Production from ceramic increases the service life and reduces the maintenance effort. Moreover, a specific coefficient of friction can be provided on the surface by appropriate selection of this material.

The braking element and/or the contact pressure element may have an indentation for guiding the cable.

This enables the cable to be guided easily and precisely, and ensures that the braking process is reproducible repeatedly.

The contact pressure element is preferably supported so as to be rotatable about an axis of rotation extending transversely to the conveying direction.

This enables to the contact pressure element to co-rotate together with the motion of the conductor. This means that there is little or no slippage between the surface of the contact pressure element and the conductor. The wear and effects caused by the contact pressure element or its friction surface on the conductor may thus be reduced further.

The braking element is preferably attached to a fastening unit which is arranged detachably on the device. The fastening unit enables secure fastening of the braking element to the device. An angle plate with an attachment side may be provided as a fastening unit, so that the braking element arranged on the fastening unit may be fastened to the device repeatedly in reproducible manner. The detachable arrangement of the fastening unit enables the braking element to be replaced, while angle plates of different sizes and/or braking elements furnished with different friction surfaces can be arranged on the device.

The braking element is advantageously attached inseparably, e.g. bonded, to the fastening unit, so that uncontrolled detachment of the braking element from the fastening unit may be prevented.

Alternatively or additionally, the braking element is clamped together with the fastening unit, advantageously with the aid of a clamping claw, so that the braking element can be positioned firmly on the fastening unit and also so that it is held mechanically when the conductor is braked, so that the braking element is immovable and does not slip.

A protection unit is advantageously arranged on the fastening unit and is advantageously arranged detachably on the fastening unit. The protection unit may be embodied as an additional angle plate and serves as access protection for the user of the of the device during the conveying and braking operation on the conductor.

Additionally or alternatively, it may be provided that the braking element is mounted so as to be rotatable about an axis of rotation aligned transversely to the conveying direction. In this context, the braking element may be arranged so as to be rotatable on the fastening unit so that is can easily be replaced together with the fastening unit and can easily be mounted on the fastening unit.

This makes it possible for the braking element to rotate with the movement of the conductor. This means that there is only little or no slippage between the surface of the braking element and the conductor. The wear and effects of the braking element, or the corresponding friction surface, on the conductor may thus be reduced further.

At the same time, it may be provided that an inhibitor is arranged on the braking element. This serves to retard the braking element.

Preferably, an additional braking element is present and is mounted so as to be rotatable about an axis of rotation aligned transversely to the conveying direction. Then, the braking element and the additional braking element may be arranged beside and at a distance apart from one another, so that at least sections of the contact pressure element may be guided between the two braking elements. In this way, the conductor arranged between the contact pressure element and the two braking elements may be at least partly relieved of mechanical conductor stresses by means of a walking process during braking. The additional braking element may be of the same construction as the braking element described previously, particularly in terms of the design of the friction surface and/or the indentation.

More preferably, a braking device is provided, as least a part of which is in a contactless operative braking connection with at least one of the two braking elements when in an activated state. In the activated, state, the braking device exerts a braking effect on at least one of the two braking elements with the effect that the rotating speed thereof is reduced. During this process, the braking device does not touch either of the two braking elements, so there is no heat generated in the rotating braking elements caused by mechanical friction effects. At the same time, the linear motion or pivoting of the contact pressure element may be used to adjust the diameter of the conductor and the operative braking connection may be largely transferred from the braking device.

The contactless operative braking connection is preferably adjustable. This makes it possible for the braking speed, and therewith the deceleration acting on at least one of the two braking elements to be adapted to different properties of the conductor, such as the conductor diameter, the conductor type or the thickness of the conductor insulation layer.

The braking device is preferably a magnetic braking device, wherein the magnetic braking device comprises at least one permanent magnet or at least one electromagnet. Magnets such as permanent magnets or electromagnets can be useful for enabling simple, efficient braking effect on at least one of the two braking elements.

The permanent magnets are advantageously cylindrical or disc-shaped so that they can be arranged in the braking device and easily aligned specifically for a given application. Further alternative variants of the shape of the permanent magnets in the braking device would be for example a square, annular, round or segment shape.

It may be provided that an eddy current brake, particularly a controlled eddy current brake is arranged on or in the braking element for the purpose of adjusting the braking force. Activating the eddy current brake counteracts a rotation of the braking element in the conveying direction. In other words, when the eddy current brake is inactive, the braking element freewheels, when the eddy current brake is active freewheeling is prevented. If the eddy current brake is controlled, the braking force can be adjusted correspondingly. The eddy currents induced by the eddy current brake in the at least one rotating braking element are generated by the magnetic field lines, giving rise to a system of forces which decelerates the at least one rotating braking element. The heat caused thereby in at least one of the two braking elements and the heat transmitted to the conductor therefrom is negligible compared with the heating of the conductor with mechanical braking.

Alternatively or additionally, it may be provided that an eddy current brake, particularly a controlled eddy current brake as described previously, is arranged on or in the additional rotatably mounted braking element for adjusting the braking force.

Alternatively or additionally, it may be provided that an eddy current brake, particularly a controlled eddy current brake as described previously, is arranged on or in the rotatably mounted contact pressure element for adjusting the braking force. This provides a way for further active braking of the contact pressure element.

Alternatively, the magnetic braking device is a hysteresis brake comprising at least two permanent magnets and a positioning unit for moving the at least two permanent magnets. The rotating braking element described here is embodied as a hysteresis disc or hysteresis ring of the hysteresis brake, and is made from a magnetic material, a ferromagnetic material for example. The at least two permanent magnets create a magnetic flux within the rotating braking element. The following operating principle applies: Oppositely positioned magnetic poles deliver the smallest torque. But if the south and north poles of the magnets are alternated around the circumference of the hysteresis disc, the strongest reversal of magnetism takes place and the torque is greatest. By changing the angle of superposition of the magnetic poles, the torque can be adjusted steplessly, and since there are no touching surfaces present the setting is retained without limitation. At the same time, the torque applied to the rotating braking element is distributed independently of the speed of said roller, and consequently evenly from standstill to maximum speed.

More preferably, the braking device comprises a positioning apparatus for at least partly moving the braking device from a first position, in which the braking device is in an inactive state, to at least a second position, in which the braking device is in an activated state, wherein the positioning apparatus includes a drive device which displaces the at least one permanent magnet relative to the braking element and/or to the additional braking element or to the contact pressure element at least pneumatically, hydraulically or electrically. In the inactive state, no braking effect at all acts on at least one of the two rotating braking elements or on the contact pressure element. The braking device can be activated directly with the aid of the positioning apparatus, as the distance between the braking device and at least one of the rotatable braking elements will decrease so that the braking effect is created on the at least one rotatable braking element or the rotatable contact pressure element. Advantageously, at least one permanent magnet is connected to a positioning apparatus for moving the permanent magnet from a first position, in which the permanent magnet is in an inactive state, to at least a second position, in which the permanent magnet is in an activated state. The at least one permanent magnet can be activated directly with the aid of the positioning apparatus, as the distance from the rotatable braking element will decrease so that the braking effect is created on the rotatable braking element.

Advantageously, the device comprises an additional braking device with an additional positioning apparatus for at least partly moving the additional braking device from a first position, in which the additional braking device is in an inactive state, at least to a second position, in which the additional braking device is in an active state, wherein the additional positioning apparatus includes an additional drive device which displaces at least one additional permanent magnet relative to the contact pressure element pneumatically, hydraulically or electrically. In the inactive state, no braking effect at all acts on the rotatably mounted contact pressure element. The additional braking device can be activated directly with the aid of the additional positioning apparatus, as the distance between the additional braking device and the rotatably mounted contact pressure element is decreased so that the braking effect is created on contact pressure element.

The device for braking a conductor may include an actuator for actuating the positioning apparatus, in particular for actuating the pivotably mounted brake lever in such manner that a distance between the braking element and the contact pressure element is adjustable in relation to actuator-pressing force and diameter of the conductor. In particular, the actuator may be embodied as a pneumatic cylinder or may include a pneumatic cylinder.

An actuator makes it possible to adjust the braking force mechanically, that is to say adjustment of the distance between the braking element and the contact pressure element. It is also possible to adjust the pressure force mechanically, that is to say the braking force which acts on the conductor between braking element and contact pressure element.

The contact pressure element may advantageously be moved closer to the at least one braking element with the aid of the actuator, wherein the actuator is connected to the brake lever. In this manner, the pressure force acting on the braking element is particularly easily adjustable, and the size of the device remains compact.

A device such as the one described in this document is typically part of larger cable processing device. This cable processing device typically already has drives and/or components which are operated by compressed air. If the actuator is a pneumatic cylinder, it can easily be incorporated in an existing installation.

The device may include a regulator and/or a control/activation device for adjusting a pressing force of the contact pressure element.

This makes it possible to actuate the contact pressure element easily. The controller may be integrated in the machine controller or the controller of a cable processing machine, and in particular control the device on the basis of additional machine parameters. This in turn enables the braking of the conductor to a standstill to be adjusted with the utmost precision, so that loop formation may be prevented and the effect of stress on the conductor may be reduced.

More preferably, the regulator and/or the controller for adjusting the braking force is connected electrically to the drive device. In this way, it is possible to regulate the drives of the device with one central regulator or with one central control or activation device, wherein the regulation of the drives may synchronise them with each other.

The device may have a retaining assembly, in particular a spring-operated retaining assembly for holding the positioning apparatus, in particular the brake lever, in a neutral position. For this purpose, the retaining assembly may be equipped with a movable retaining element, which may be actuated in particular pneumatically and fixes the brake lever securely in the neutral position. The movable retaining element may be introduced into a brake lever mounting point of the brake lever to fix the brake lever in the neutral position.

In this way, the positioning apparatus or the brake lever may be held firmly in a predefined position, in the present case a neutral position. The neutral position is the position in which the cable can be inserted in the device, on other words the brake is open.

An arrangement of such kind makes it possible to manipulate the device easily and to insert a conductor that is to be guided in the device or to remove it therefrom.

The brake lever can be moved to the neutral position by hand or alternatively also by a pneumatic drive, for example a pneumatic cylinder, and held there so that the conductor can be inserted in the device manually. Thus, the movement of the brake lever to the neutral position is controllable.

The retaining assembly may be embodied as a spring loaded detent, with which the positioning apparatus, in particular the brake lever, engages in the neutral position, for example with a corresponding projection.

A preloading apparatus may be arranged on the positioning apparatus, in particular on the brake lever to apply in particular a specific biasing force to the contact pressure element. The preloading apparatus may in particular be embodied as a spring.

This ensures that in its working position, that is to say the position in which the contact pressure element acts on the conductor and the conductor is clamped between the contact pressure element and the braking element, in other words when the brake is closed, the positioning apparatus, in particular the brake lever, exerts a certain pressure on the conductor via the contact pressure element.

The preloading apparatus on the brake lever is preferably arranged opposite the contact pressure element with respect to the pivot axis of the brake lever.

This enables the device to be of simple construction.

It may be provided that an actuating lever is arranged on the positioning apparatus, in particular on the brake lever, to allow the positioning apparatus or the brake lever to be actuated manually. In particular, it may be provided that the actuating lever be disposed in such manner that the positioning apparatus or the brake lever may be moved into its neutral position.

This makes it possible to actuate the positioning apparatus, in particular the brake lever, even if the device itself is de-energised, in the event of a power failure, for example. The actuating lever makes it possible to actuate the brake lever or the positioning apparatus by hand and to insert a conductor in the device or remove it therefrom.

In a preferred embodiment, the positioning apparatus and preferably the brake lever with its pivot pin, the actuator for actuating the brake levers and the braking element are arranged on a common support.

This makes is easy for the device to be produced and supplied in the form of a compact unit. It is easy to define relative distances between the elements.

A further aspect of the present invention relates to a method for braking a conductor in a device, wherein the method comprises the following steps:

- Arranging a conductor along a conveying direction for braking the conductor;
- Actuating a preloading apparatus so that a brake lever is shifted from a neutral position into a working position;
- Transporting the conductor along the conveying direction in the device for braking the conductor, wherein the conductor bears on a braking element;
- Braking the conductor, wherein the conductor is brought into operative connection with the braking element by moving the contact pressure element relative to the braking element with the aid of a positioning apparatus and/or actively braking the braking element.

A method of such kind makes it possible to guide the conductor in the conveying direction under tension along the braking element. In these circumstances, with the brake lever in its working position the conductor is clamped between the contact pressure element and the braking element and loaded with a biasing force, wherein the conductor may be conveyed in the conveying direction substantially without braking. It is further made possible for the contact pressure element to act directly on the conductor, thus to bring the conductor into operative connection with the braking element and in particular to clamp the conductor between the braking element and the contact pressure element. At the same time it is possible to brake the conductor to a standstill, wherein the standstill of the conductor may be set with pinpoint precision. The braking is performed with the aid of the positioning apparatus and/or by actively braking the braking element. This serves to prevent the formation of loops in the conductor after the device for braking and/or before the additional processing of the conductor in a cable processing machine. In particular, the method for braking a conductor is carried out on the device for braking a conductor described previously.

Alternatively or additionally, braking of the conductor is carried out with an additional braking element which is also brought into operative connection with the additional braking element, by moving the contact pressure element relative to the additional braking element and/or actively braking the additional braking element. This in turn further enhances the precise braking of the conductor.

Alternatively or additionally, the rotating braking element and/or the additional braking element is/are braked actively, so that the rotating speed thereof is reduced. As a result, no heat is generated in the rotating braking element and/or the additional braking element by mechanical friction effects.

Alternatively or additionally, the rotating contact pressure element is braked actively, so that its rotating speed is reduced. As a result, no heat is generated in the rotating contact pressure element by mechanical friction effects.

When the brake lever is in the work position, it preferably exerts a pre-tensioning force on the conductor. This is enabled for example by a compression spring. Then, the conductor is only clamped between the contact pressure element and the braking element and guided between them in the conveying direction.

The preloading apparatus preferably includes an actuating lever which is actuated manually. This makes the brake lever and the preloading apparatus easy for the user to actuate.

More preferably, during braking the brake lever is pressed against the conductor, and pressure force or braking force is exerted on the conductor as well as the biasing force, causing the conductor to be decelerated.

In particular, during braking the contact pressure element is pressed against the conductor with the aid of an actuator. The actuator exerts an adjustable pressure force on the conductor.

Alternatively or additionally, the contact pressure element is pressed against the conductor with the aid of a pneumatic cylinder. The contact pressure element is pressed and/or pulled against the conductor in controllable manner, so that the conductor can be braked to a standstill with extreme precision.

The contact pressure element is preferably pivoted or moved linearly towards the braking element. This enables simple adjustment of the braking force and simple movement of the contact pressure element relative to the braking element.

Alternatively or additionally, at least a section of the braking device is shifted from a first position, in which the braking device is in an inactive state, to a second position, in which the braking device is in an activated state. In this context, advantageously at least one permanent magnet is moved in the braking device. In the activated state, the braking device has a decelerating effect on the braking element, so that the rotating speed thereof is reduced. In the process, the braking device does not touch the braking element, with the result that no heat is generated in the rotating braking element due to mechanical friction effects.

Alternatively or additionally, at least a section of an additional braking device is shifted from a first position, in which the additional braking device is in an inactive state, to a second position, in which the additional braking device is in an activated state. In this context, advantageously at least one permanent magnet is moved in the additional braking device. In the activated state, the additional braking device has a decelerating effect on the contact pressure element, so that the rotating speed thereof is reduced. In the process, the additional braking device does not touch the contact pressure element, with the result that no heat is generated in the rotating contact pressure element due to mechanical friction effects.

More preferably, the braking device and/or the additional braking device has/have a decelerating effect on at least one of the two braking elements and/or on the contact pressure element contactlessly. In this way, the braking speed and therewith also the decelerating effect acting on at least one of the two braking elements and/or the contact pressure may be adapted to different properties of the conductor.

A fastening unit on the device is preferably detached. The detachable arrangement of the fastening unit enables the fastening unit to be replaced. The replacement of the fastening unit is advantageously carried out after the conductor has been braked.

In particular, the braking element is removed from the device. The removal of the braking element enables braking elements for different conductors to be used or arranged in the device.

More preferably, during braking of the conductor the braking force is adjusted with a control or activation unit, which may be connected to the actuator and/or to the pneumatic cylinder and transmits regulation commands and/or control commands, thereby enabling a deliberate, precise deceleration of the conductor to a standstill.

The controller or regulator or the activation unit preferably transmits regulation commands and/or control commands to the drive devices of the braking device and/or of the additional braking device. In this way, the device can be controlled with one central controller.

A further aspect of the present invention relates to a cable processing machine comprising a device as described in the present document, wherein the conductor is braked in particular with the aid of the method for braking des conductor as described in the present document. This enables the production of a complete cable processing machine wherein all components are tuned to each other.

The invention will be explained in greater detail with reference to figures which only represent exemplary embodiments thereof.

THE FIGURES SHOW

Figure 2:
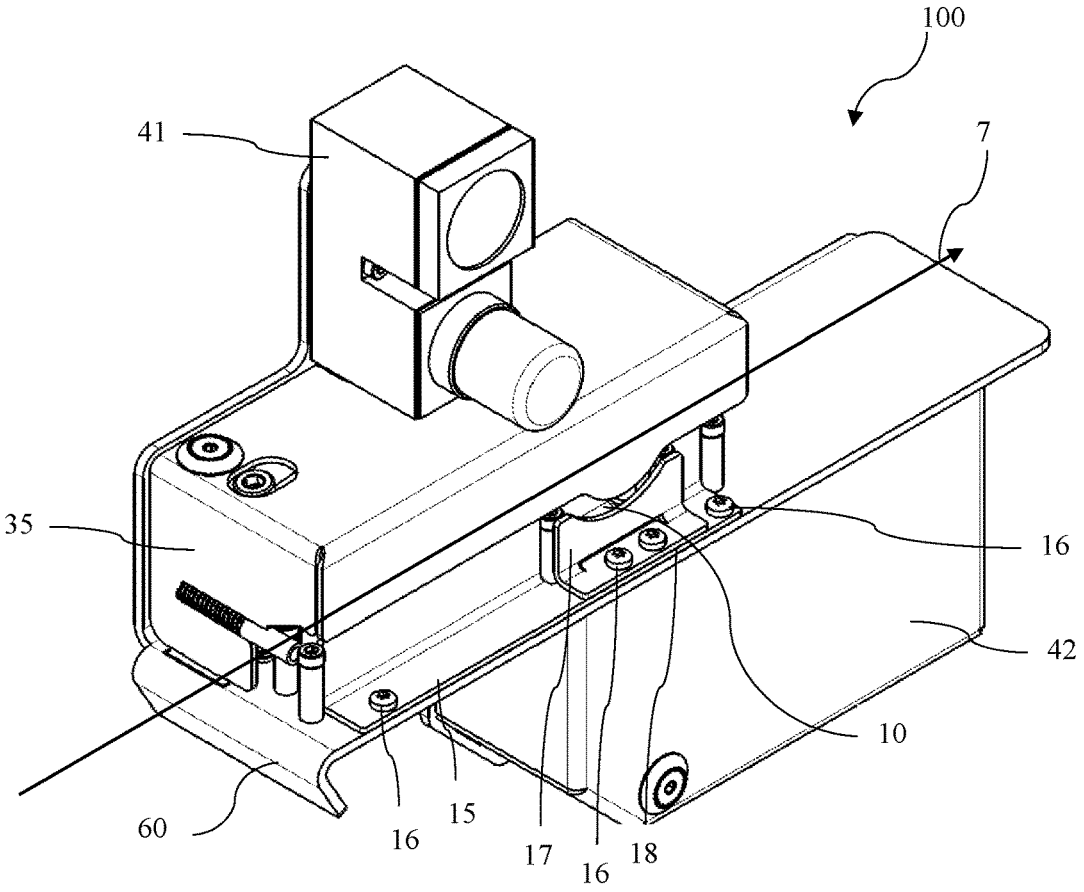
Figure 3:
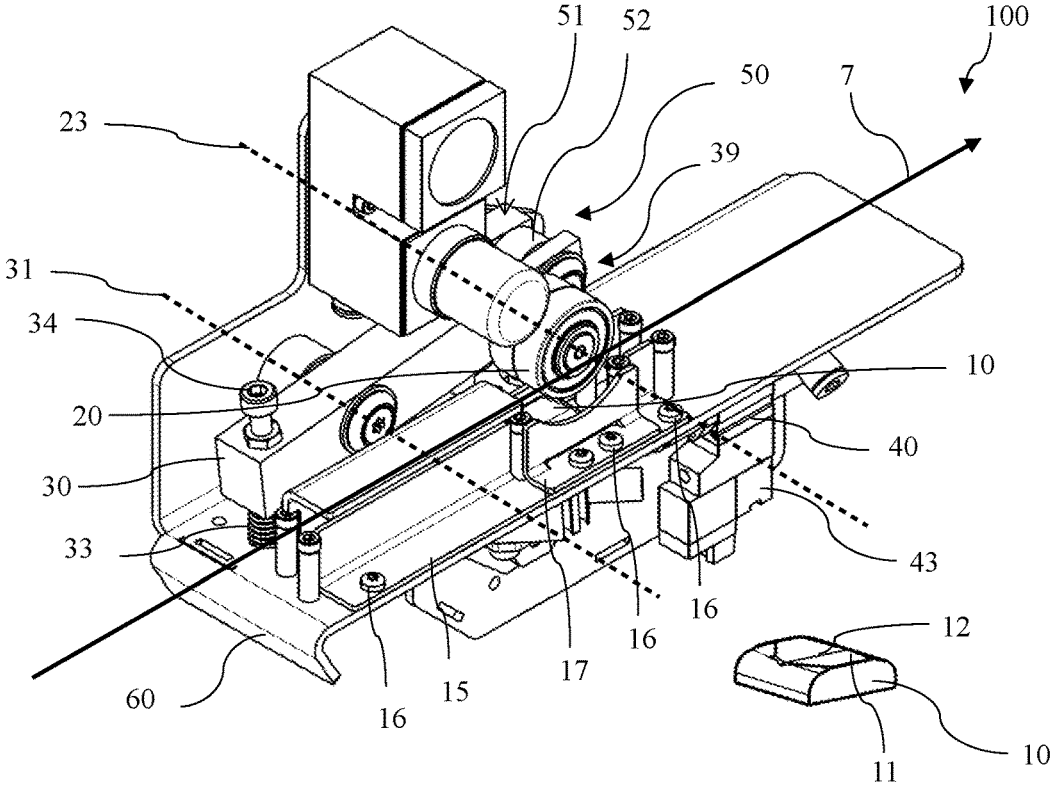
Figure 4:
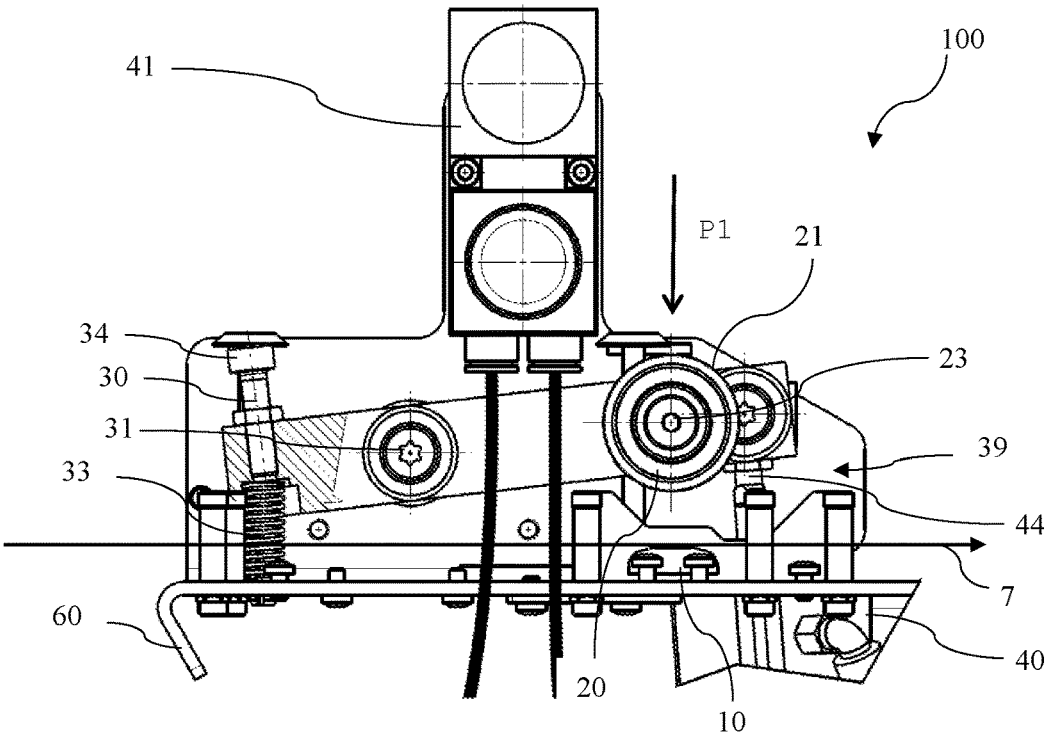
Figure 5:
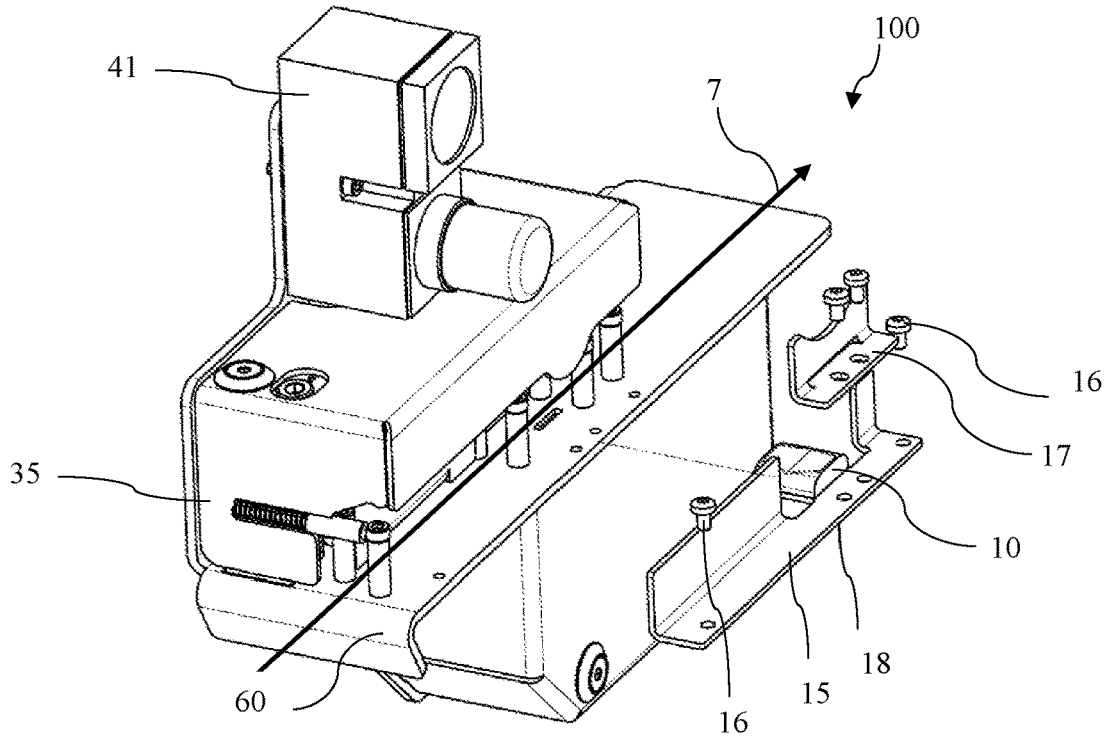
Figure 6:
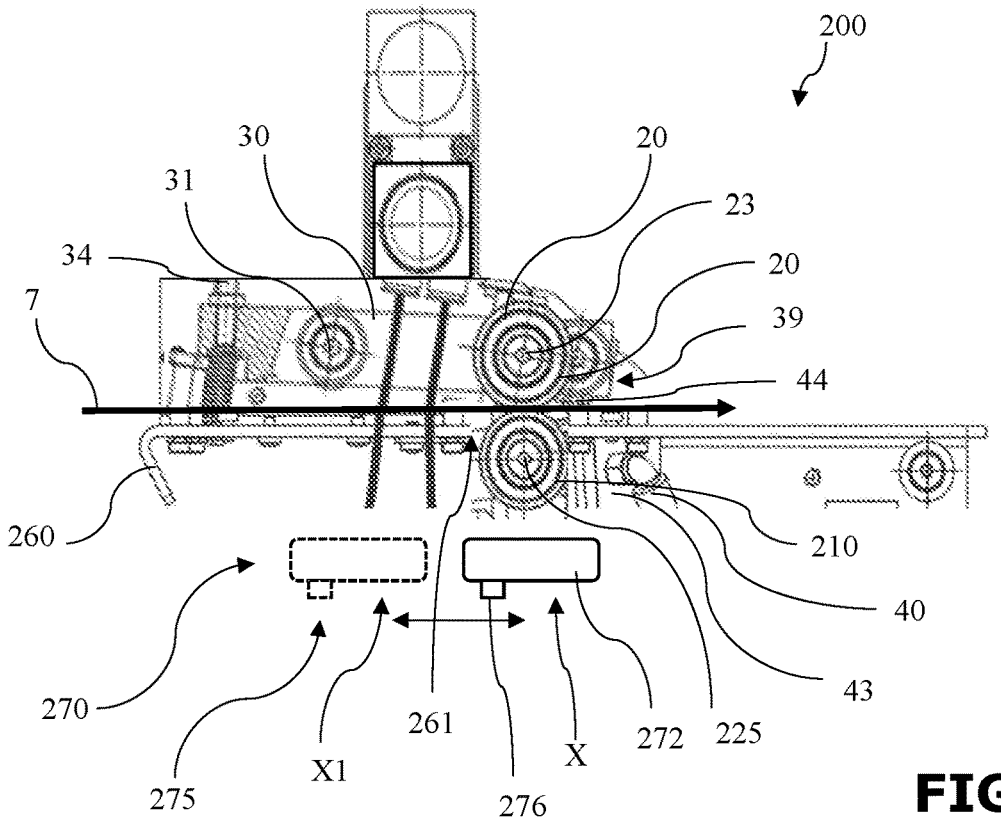
Figure 7:
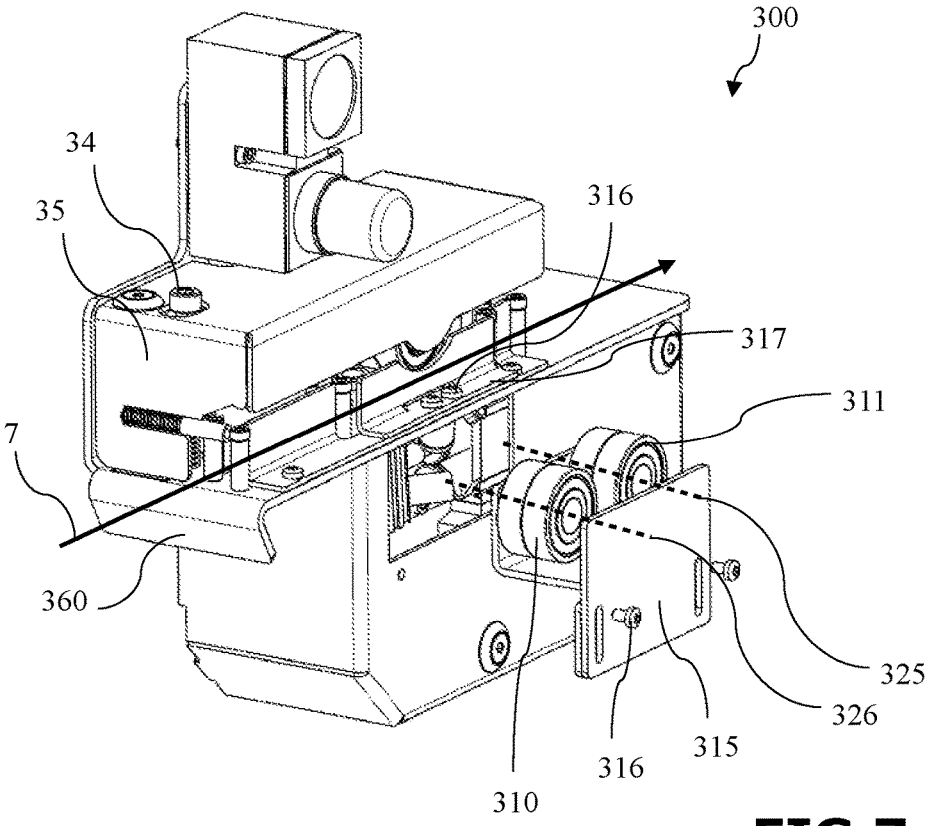
Figure 8:
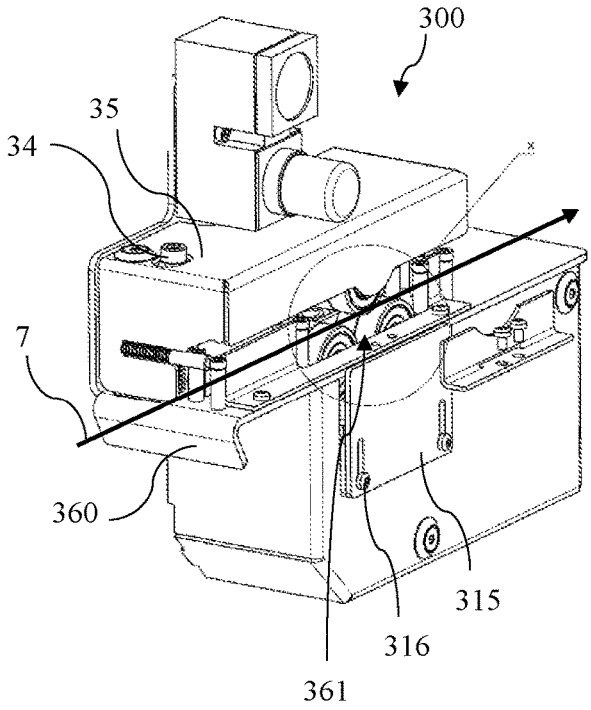
Figure 9:
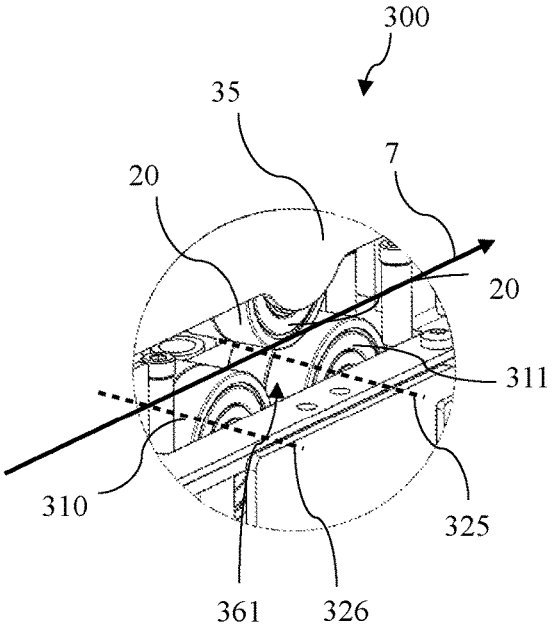
Figure 10:
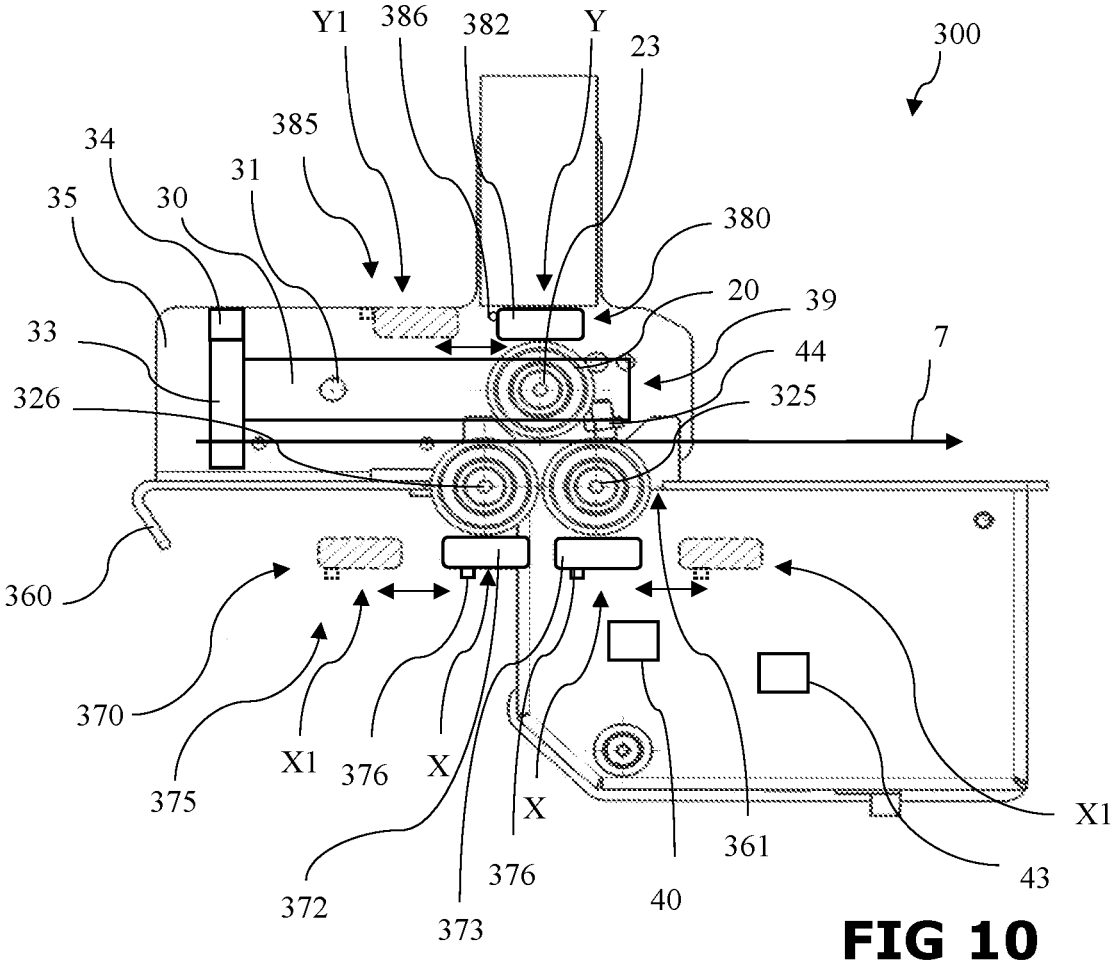
Figure 11:
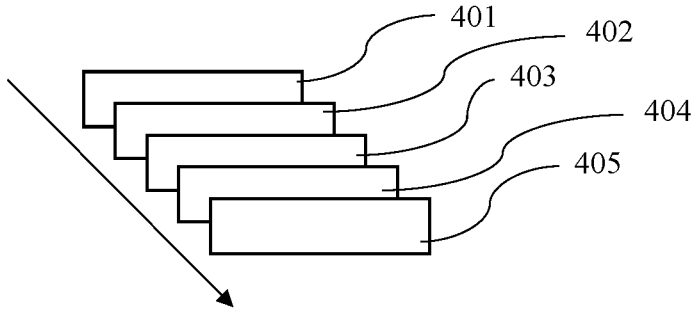

FIG. 1 a cable processing machine;

FIG. 2 a perspective view of a device for braking a conductor;

FIG. 3 the view of FIG. 2 with some elements hidden;

FIG. 4 an orthogonal representation of the view of FIG. 3;

FIG. 5 a further perspective view of the device for braking the conductor according to FIG. 2, with a braking element detached from the device;

FIG. 6 a further variant of the of the device for braking a conductor with a cross-sectional view of the braking device;

FIG. 7 a perspective view of a further variant of the device for braking a conductor with an additional braking device;

FIG. 8 another perspective view of the device according to FIG. 7;

FIG. 9 another perspective view of the device according to FIG. 8;

FIG. 10 a cross-sectional view through the device according to FIG. 7 with a braking device;

FIG. 11 a flowchart showing method steps for braking a conductor.

FIG. 1 shows a cable processing machine 1 comprising a device 100 for braking a conductor. The conductor is extracted from a cable storage unit—not described in more detail—and passed via a deflection 5 through the device 100 for braking a conductor and is then processed in the cable processing machine 1. Cable processing machine 1 is a crimping machine. It is equipped with two protective hoods 2 and 4, wherein among other things the actual crimping tool is located inside the protective hoods 2 and 4 and in the present cast is not visible. After processing, the product to be processed, in the present case a cable, is transported on a conveyor belt 3 and stored in a collecting tray—not described in greater detail here. The general processing direction is indicated in FIG. 1 by the arrow. This corresponds substantially to the conveying direction 7 of the conductor. A conductor alignment mechanism 6 and a line feed device—no shown here—are positioned after the device 100 for braking a conductor in conveying direction 7.

FIG. 2 shows a perspective view of a device 100 for braking a conductor. A conductor—not shown here—extends through the device 100 in the direction of the arrow (conveying direction 7). The lower part of the device 100 includes an actuator housing 42, and the upper part has a brake lever housing 35. A regulator 41 is arranged above the brake lever housing 35. The device 100 comprises the braking element 10, which is arranged on a fastening unit 15, which is embodied as an angle plate and which are arranged on a common support 60. The fastening unit 15 is arranged with its attachment side 18 precisely on the support 60. A protection unit 17 is arranged as access protection on the fastening unit 15. The fastening unit 15 and the protection unit 17 are each arranged detachably on the support 60 with the aid of fastening means 16.

FIG. 3 shows the view of FIG. 2 with some of the elements hidden. In FIG. 3, both the actuator housing 42 (see FIG. 2) and the brake lever housing 35 (see FIG. 2) are hidden. Consequently, the elements located inside the respective housings can be seen. Inside the braked housing 35 (see FIG. 2) is a brake lever 30, on which brake lever 30 a contact pressure element 20 is mounted so as to be rotatable about an axis of rotation 23. The brake lever 30 is mounted in pivotable manner about a pivot axis 31 and in the present case forms the positioning apparatus 39. The preloading apparatus 33 is arranged opposite the contact pressure element 20 with respect to the pivot axis 31. An actuator 40, in the present case embodied as a pneumatic cylinder, is arranged underneath the device 100, that is to say inside the actuator housing 42 (see FIG. 2). The actuator 40 is connected movably to the brake lever 30 via elements that are not described more closely, via a pneumatic cylinder 44 for example, and enables it to pivot the brake lever 30 about the pivot axis 31, thus pulling the brake lever 30 towards the support 60. In the present illustration, the braking element 10 is only partly visible below the contact pressure element 20. The braking element 10 is glued to the fastening unit 15, which is embodied as an angle plate, and therewith arranged detachably on the device 100. In order to detach the fastening unit 15, in this representation screws are provided as fastening means 16. In order to maintain clarity of the illustration, in FIG. 3 this is shown separately, beside the device 100. The braking element 10 has a friction surface 11 and is furnished with an indentation 12 for accommodating the conductor. In the present case, the braking element 10 is made from ceramic and manufactured as a single part. The braking element 10 is arranged detachably on the device 100. The regulator 41 for adjusting the pressure on the actuator 40 and the activation unit 43, with which the actuator 40 is controlled, can also be seen in the present illustration. Also visible is the retaining assembly 50, which in the present case is embodied as a resilient compression member. The retaining assembly 50 has a movable retaining element 51, which is a resilient compression member and can be inserted in a brake lever mounting point 52 on the brake lever 30 to fix the brake lever 30 in the neutral position.

FIG. 4 shows an orthogonal representation of the view from FIG. 3. For the purpose of clarity, the only a part of the actuator 40 is shown. Two pneumatic lines—not described more closely—which are also only partially shown, are located on the regulator 41. FIG. 4 shows how the individual elements cooperate. The brake lever 30 is mounted so as to be pivotable about the pivot axis 31. The contact pressure element 20 is arranged on the brake lever 30 and can be moved in the direction of the arrow P1 by a pivoting motion of the brake lever 30. This pivoting motion is triggered by activation of the actuator 40. The force with which the conductor is clamped between the contact pressure element 20 and the braking element 10 is varied according to the force with which the actuator 40 is activated. At the same time, the force with which the conductor is clamped between the contact pressure element 20 and the braking element 10 acts as a braking force and is applied with the aid of the pneumatic cylinder 44. The conductor is decelerated correspondingly more or less sharply by the application of a braking force.

The illustration according to FIG. 4 corresponds to the neutral position, which means that the brake is open, wherein the pneumatic cylinder 44 of the positioning apparatus 39 fixes the brake lever 30 in the neutral position. In this position, it is possible to insert a conductor correspondingly in the device. The direction of the conductor corresponds substantially to the direction of the arrow shown between the contact pressure element 20 and the braking element 10. This arrow also indicates the conveying direction of the conductor. In the present example, the contact pressure element 20 is embodied as a ball bearing or a roller bearing, the outer circumference of which is equivalent to the friction surface 21. The ball bearing or roller bearing is correspondingly mounted so as to be rotatable about the axis of rotation 23. The preloading apparatus 33, in the present case embodied as a helical spring or compression spring, is arranged opposite the contact pressure element 20 with respect to the pivot axis 31. The actuating lever 34 for manual actuation of the brake lever 30 is also arranged close to the preloading apparatus 33 on the brake lever 30. In this example, all components are arranged on a common support 60.

FIG. 5 shows the device 100 according to FIG. 2, wherein the fastening unit 15 including the braking element 10 is detached or separated from the device 100. To do this, the fastening means 16 were undone so that the protection unit is also separated from the fastening unit 15. The fastening unit 15 must be attached by its attachment side 18 on the support 60. The braking element 10 may thus be replaced with an additional braking element, which has a differently shaped indentation to indentation 12, for example, and/or friction surface which is shaped differently from the friction surface 11 (not shown).

FIG. 6 shows a device 200 for braking a conductor. Here, the device 200 includes largely the same features and components as those illustrated previously in the device 100 of FIGS. 2 to 5. The device 200 according to FIG. 6 differs from the device 100 of FIG. 2 to FIG. 5 in that the braking element 210 is mounted so as to be rotatable about an axis of rotation 225, and a braking device 270 is provided for contactless braking of the rotatably mounted braking element 210. The illustration according to FIG. 6 corresponds to the braking position of the contact pressure element 20, which means that the brake is active, so the conductor (not shown) may be actively clamped between the contact pressure element 20 which is mounted rotatably about the axis of rotation 23 and the braking element 210 and can be braked manually. The actuator 40 is connected to the brake lever 30 and makes it possible to pivot the brake lever 30 about the pivot axis 31, so that the conductor is clamped or the clamping is released. The support 260 includes a support aperture 261 through which a section of the braking element 210 protrudes. A braking device 270 is arranged in the drive housing 201 of the device 200, which braking device is embodied in this case as an eddy current brake and comprises a permanent magnet 272. The permanent magnet 272 is movable mechanically with the aid of a positioning apparatus 275 from a first position X1, in which the permanent magnet 272 is in an inactive state, to a second position X, in which the permanent magnet 272 is in an activated state. The permanent magnet 272 may be moved back into first position X1 with the aid of the positioning apparatus 275. In order to move the permanent magnet 272, the positioning apparatus 275 is equipped with a drive device 276 which shifts the permanent magnet 272 relative to the braking element 210.

The drive device 276 is electrically connected to the control/activation 43, so that the control commands are transmitted to the drive device 276 from one central control/activation 43.

FIGS. 7 to 10 show a device 300 for braking a conductor. Here, the device 300 includes largely the same features and components as those illustrated previously in the devices 100 and 200 shown respectively in FIGS. 2 to 5 and FIG. 6. The device 300 according to FIGS. 7 to 10 differs from the device 200 of FIG. 6 in that an additional braking element 311 is present besides a first braking element 310, and each is mounted so as to be rotatable about a respective axis of rotation 325, 326, and a braking device 370 is provided for braking the rotatably mounted braking elements 310, 311.

The device 300 comprises a fastening unit 315 which is embodied as an angle plate, on which the braking elements 310, 311 are arranged rotatably, wherein the rotatably mounted braking elements 310, 311 are arranged beside and at a distance apart from one another. In the braked position, at least a section of the contact pressure element 20 supported between the two braking elements 310, 311 (see FIG. 8 or FIG. 9). In this way, the conductor which is arranged between the contact pressure element 20 and the two braking elements 310, 311 is relieved of conductor stresses in conveying direction 7 during braking by the walking process.

The fastening unit 315 is arranged on the common support 360, which is furnished with a support aperture 361, through which portions of the braking elements 310, 311 protrude. A protection unit 317 is arranged on the fastening unit 315. The fastening unit 315 and the protection unit 317 are each arranged detachably on the support 360 with the aid of fastening means 316. In this illustration, screws are provided as the fastening means 316 to enable the fastening unit 315 to be detached.

The representation of the device 300 according to FIG. 10 corresponds to the braking position of the contact pressure element 20, that is to say the brake is active, so the conductor (not shown) may be actively clamped between the contact pressure element 20 which is mounted so as to be rotatable about the axis of rotation 23, and the braking elements 310 and 311 and may be braked mechanically. The actuator 40 is movably connected to the brake lever 30 and makes it possible to pivot the brake lever 30 about the pivot axis 31 so that the conductor is clamped therein. The support 360 has a support aperture 361, through which sections of the braking elements 310 and 311 protrude. A first braking device 370, embodied as an eddy current brake for decelerating the braking element and comprising the permanent magnets 372, 373, is arranged in the drive housing 301 of the device 300. The permanent magnets 372, 373 are mechanically connected to a positioning apparatus 375 for moving the permanent magnets 372, 373 from a first position X1, in which the permanent magnets 372, 373 are in an inactive state, at least to a second position X, in which the permanent magnets 372, 373 are in an activated state. The permanent magnets 372, 373 may be moved back into the first position X1 with the aid of the positioning apparatus 375. In order to move the permanent magnets 372, 373, the positioning apparatus 375 is equipped with a drive device 376 which displaces the permanent magnets 372, 373 relative to the braking elements 310, 311, corresponding to the movement arrows in FIG. 10. The drive device 376 is electrically connected to the control/activation 43 so that the control commands are transmitted to the drive device 376 from one central control/activation 43.

The brake lever housing 35 of the device 300 accommodates an additional braking device 380 which is embodied as an eddy current brake for braking the contact pressure element 20 and comprises the permanent magnet 382. The permanent magnet 382 is mechanically movable with the aid of a positioning apparatus 385 from a first position Y1 in which the permanent magnets 382 is in an inactive state, at least to a second position Y, in which the permanent magnet 382 is in an activated state. The permanent magnets 382 may be moved back into the first position Y1 with the aid of the positioning apparatus 385. In order to move the permanent magnet 382, the positioning apparatus 385 is equipped with a drive device 386 which displaces the permanent magnet 382 relative to the contact pressure element 20, corresponding to the movement arrow in FIG. 10. The drive device 386 is electrically connected to the control/activation 43 so that the control commands are transmitted to the drive device 386 from one central control/activation 43.

A further variant of the device 300—not shown—comprises the braking device 370 described previously but not the additional braking device 380, which was also described earlier.

The flowchart of FIG. 11 discloses the method for braking the conductor, wherein the reference characters used refer to the previously described devices according to FIGS. 4 and 6. In a first step 401, a conductor is arranged in the device 100 along a conveying direction 7. In a next step 402, a preloading apparatus 33 is actuated so that the brake lever 30 is shifted from a neutral position (see FIG. 4) into a working position (see FIG. 6), wherein the conductor is pre-tensioned and clamped between contact pressure element 20 and braking element 10 with the aid of the brake lever 30 mounted on the pivot axis 31 and by the compression spring of the preloading apparatus 33. The preloading apparatus 33 is actuated manually using the actuating lever 34. Then, the conductor is moved along the conveying direction 7 (step 403).

Afterwards, in order to brake the conductor the conductor is brought into operative connection with the braking element 10 by moving the contact pressure element 20 relative to the braking element 10 with the aid of the pneumatic cylinder 44 of the positioning apparatus 39 (step 404). In this process, the compressed air is switched in at the actuator 40, so that the resulting braking force—which is generated by the pneumatic cylinder—between the contact pressure element 20 and the braking element 10 acts on the clamped conductor.

In a next step, the permanent magnet 272 of the braking device 270 is shifted from a first position X1, in which the braking device 270 is in an inactive state, to a second position X, in which the braking device 270 is in an activated state (step 405). In this process, neither the braking device 270 nor the permanent magnet 272 touches the braking element 10.

In the method disclosed above, the control or regulator 41 or the activation 43 transmits regulation commands and/or control commands to the drive device 276 of the braking device 270. In this way, it is possible to control the device with one central control. The actuator 40 is not activated by the activation/control 43 except to brake the conductor, and the pneumatic cylinder 44 is then pressurised so that the conductor between contact pressure element 20 and braking element 10 is exposed to the braking force corresponding to the pneumatic pressure acting on the actuator 40. This braking force also gives rise to a marked walking effect on the conductor.

After this, at least after braking of the conductor, the fastening unit 15 can be detached from the device 100 and the braking element 10 can be removed from the device 100.

The list of reference characters is as much a part of the disclosure as the technical content of the patent claims and figures. The same reference characters signify identical components.

LIST OF REFERENCE SIGNS

100 Device
1 Cable processing machine
2 Protective hood
3 Conveyor belt
4 Protective hood
5 Deflection
6 Conductor alignment mechanism
7 Conveying direction
10 Braking element
11 Friction surface
12 Indentation
15 Fastening unit
16 Fastening means
17 Protection unit
18 Attachment side for 15

20 Contact pressure element
21 Friction surface
23 Axis of rotation
30 Brake lever
31 Pivot axis
33 Preloading apparatus
34 Actuating lever
35 Brake lever housing
39 Positioning apparatus
40 Actuator
41 Regulator
42 Actuator housing
43 Activation/Control
44 Pneumatic cylinder
50 Retaining assembly
51 Retaining unit
52 Brake lever mounting point
60 Support
200 Device
201 Device housing
210 Braking element
225 Axis of rotation
260 Support
261 Support aperture
270 Braking device
272 Permanent magnet
275 Positioning apparatus
276 Drive device
300 Device
301 Drive housing
310 First braking element
311 Additional braking element
315 Fastening unit
316 Fastening means
317 Protection unit
325 Axis of rotation
326 Axis of rotation
360 Support
361 Support aperture
370 Braking device
372 Permanent magnet
373 Permanent magnet
375 Positioning apparatus
376 Drive device
380 Additional braking device
382 Permanent magnet
385 Additional positioning apparatus
386 Additional drive device
401 to 405 Method steps
P1 Direction of motion
Y First position of 282
Y1 Second position of 282
X First position of 272 or 372
X1 Second position of 272 or 372

The invention claimed is:

1. A cable processing device (100; 200; 300) for braking a conductor the cable processing device (100; 200; 300) comprising:

a braking element (10; 210; 310, 311), and a contact pressure element (20), both of which are able to be put into an operative connection with the conductor guided in a conveying direction (7) in the cable processing device (100; 200; 300), wherein the contact pressure element (20) is arranged opposite the braking element (10; 210; 310, 311), wherein the braking element (10; 210; 310) and the contact pressure element (20) are movable relative to each other, and the contact pressure element (20) is arranged on a positioning apparatus (39) and on a brake lever (30) which is mounted in a pivotable manner on a pivot axis (31), and wherein the device (100; 200; 300) is equipped with a regulator (41) and/or controller (43) for adjusting a distance or a braking force between the braking element (10; 210; 310) and the contact pressure element (20).

2. The cable processing device (100; 200; 300) according to claim 1, wherein the contact pressure element (20) has a friction surface (21) for cooperating with the conductor.

3. The cable processing device (100; 200; 300) according to claim 1, wherein the braking element (10; 210; 310) has a friction surface (11) for cooperating with the conductor and is made as a single part from ceramic.

4. The cable processing device (100; 200; 300) according to claim 1, wherein the contact pressure element (20) is mounted so as to be rotatable about an axis of rotation (23) aligned transversely to the conveying direction (7).

5. The cable processing device (100; 200; 300) according to claim 1, wherein the braking element (10; 210; 310) is mounted so as to be rotatable about an axis of rotation (225; 325) transversely aligned to the conveying direction (7).

6. The cable processing device (100; 200; 300) according to claim 1, wherein an additional braking element (311) is present and is mounted so as to be rotatable about an axis of rotation (326) transversely aligned to the conveying direction (7).

7. The cable processing device (100; 200; 300) according to claim 6, wherein a braking device (270; 370, 380) is present, and, in an activated state, at least a section thereof is in a contactless operative braking connection with at least one of the two braking elements (10; 210; 310, 311), the contactless operative braking connection is adjustable.

8. The cable processing device (100; 200; 300) according to claim 7, wherein the braking device (270; 370, 380) is a magnetic braking device, and the magnetic braking device comprises at least one permanent magnet (272; 372, 373, 382) or at least one electromagnet.

9. The cable processing device (100; 200; 300) according to claim 8, wherein an eddy current brake is arranged on or in the braking element (10; 210; 310) and/or the additional braking element (311) for adjusting the braking force.

10. The cable processing device (100; 200; 300) according to claim 8, wherein the braking device (270; 370, 380) has a positioning apparatus (275; 375, 385) for at least partly moving the braking device (270; 370, 380) from a first position, in which the braking device (270; 370, 380) is in an inactive state, at least into a second position, in which the braking device (270; 370, 380) is in an activated state, and the positioning apparatus (275; 375, 385) has a drive device (276; 376, 386) which pneumatically, hydraulically or electrically shifts at least the at least one permanent magnet (272; 372, 373, 382) relative to the braking element (10; 210; 310) and/or the additional braking element (311) or the contact pressure element (20).

11. The cable processing device (100; 200; 300) according to claim 1, wherein the device (100; 200; 300) is equipped with an actuator (40) which is embodied as or comprises a pneumatic cylinder (44) for actuating the positioning apparatus (39), for actuating the pivotably mounted brake lever (30) in such a manner that a distance or a braking force, between the braking element (10; 210; 310) and the contact pressure element (20), is adjustable.

12. The cable processing device (100; 200; 300) according to claim 7, wherein the cable processing device (100; 200; 300) is equipped with at least one of a regulator (41) or a control (43) for adjusting a pressing force of the contact pressure element (20).

13. The cable processing device (100; 200; 300) according to claim 1, wherein the cable processing device (100; 200; 300) is equipped with a spring actuated retaining assembly (50) for holding the positioning apparatus (39) in a neutral position.

14. The cable processing device (100; 200; 300) according to claim 1, wherein a preloading apparatus (33) is arranged on the positioning apparatus (39) for applying a biasing force to the contact pressure element (20).

15. A method for braking a conductor in a cable processing device (100; 200; 300) according to claim 1, wherein the method comprises the following steps:

arranging a conductor along a conveying direction (7);

actuating a preloading apparatus (33) so that a brake lever (30) is shifted from a neutral position into a working position;

transporting the conductor along the conveying direction (7) in the cable processing device for braking the conductor, wherein the conductor bears on a braking element (10; 210; 310);

braking the conductor, wherein the conductor is brought into operative connection with the braking element (10; 210; 310) by moving the contact pressure element (20) relative to the braking element (10; 210; 310) with aid of a positioning apparatus (39) and/or actively braking the braking element (10; 210; 310); and adjusting a braking force between the braking element (10; 210; 310) and the contact pressure element (20) using a regulator (41) and/or a control (43).

16. The method according to claim 15, wherein in the working position the brake lever (30) exerts a pretensioning force on the conductor, and the preloading apparatus (33) has an actuating lever (34) which is actuated manually.

17. The method according to claim 15, wherein during braking the brake lever (30) is pressed towards the conductor, and the contact pressure element (20) is pressed against the conductor with the aid of at least one of an actuator(s) (40) or a pneumatic cylinder (44).

18. A cable processing machine (1) comprising a cable processing device according to claim 1, and wherein the conductor is braked using the method for braking the conductor comprises the steps of:

arranging a conductor along a conveying direction (7) for braking the conductor;

actuating a preloading apparatus (33) so that a brake lever (30) is shifted from a neutral position into a working position;

transporting the conductor along the conveying direction (7) in the cable processing device for braking the conductor, wherein the conductor bears on a braking element (10; 210; 310);

braking the conductor, wherein the conductor is brought into operative connection with the braking element (10; 210; 310) by moving the contact pressure element (20) relative to the braking element (10; 210; 310) with aid of a positioning apparatus (39) and/or actively braking the braking element (10; 210; 310); and adjusting a braking force between the braking element (10; 210; 310) and the contact pressure element (20) using a regulator (41) and/or a control (43).

19. A cable processing device (100; 200; 300) for braking a conductor comprising:

a braking element (10; 210; 310, 311) which is able to be put into an operative connection with a conductor guided in a conveying direction (7) in the cable processing device (100; 200; 300), a contact pressure element (20) which is able to be put into an operative connection with the conductor guided in the cable processing device (100; 200; 300), wherein the contact pressure element (20) is arranged opposite the braking element (10; 210; 310, 311), the braking element (10; 210; 310) and the contact pressure element (20) are movable relative to each other, the contact pressure element (20) is arranged on a positioning apparatus (39) and on a linear actuating apparatus, a brake lever (270; 370; 380) is present and, in an activated state at least a section thereof, is in contactless operative braking connection with the braking element (10; 210; 310, 311), and the contactless operative braking connection is adjustable.

20. The cable processing device (100; 200; 300) according to claim 19, wherein the braking device (270; 370, 380) is a magnetic braking device, and the magnetic braking device comprises at least one permanent magnet (272; 372, 373, 382) or at least one electromagnet.

21. The cable processing device (100; 200; 300) according to claim 19, wherein an eddy current brake is arranged on or in the braking element (10; 210; 310) for adjusting the braking force.

* * * * *